US009352945B2

(12) United States Patent
Liu et al.

(10) Patent No.: US 9,352,945 B2
(45) Date of Patent: May 31, 2016

(54) EXTENDABLE JACK TOOL AND JACK ASSEMBLY EMPLOYING THE SAME

(71) Applicant: Ford Global Technologies, LLC, Dearborn, MI (US)

(72) Inventors: Brenna Liu, Nanjing (CN); Wendy Ge, Nanjing (CN); Jack Xu, Jiangsu (CN)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 38 days.

(21) Appl. No.: 14/514,459

(22) Filed: Oct. 15, 2014

(65) Prior Publication Data

US 2015/0166316 A1 Jun. 18, 2015

(30) Foreign Application Priority Data

Dec. 13, 2013 (CN) ..... 2013 1 0683939

(51) Int. Cl.
*B66F 3/00* (2006.01)
*B66F 13/00* (2006.01)
*B66F 3/12* (2006.01)

(52) U.S. Cl.
CPC . *B66F 13/00* (2013.01); *B66F 3/12* (2013.01); *Y10T 74/20738* (2015.01)

(58) Field of Classification Search
CPC ..... B66F 3/12; B66F 13/00; G05G 5/06; Y10T 74/20636; Y10T 74/2075; Y10T 74/20744; Y10T 74/20738; Y10S 254/03; B25B 23/0021; F16B 7/105; F16B 7/14; F16B 7/1409
USPC ..... 403/109.3, DIG. 4, 109.5; 16/427
See application file for complete search history.

(56) References Cited

U.S. PATENT DOCUMENTS 5,237,890 A * 8/1993 Gill ..... B66F 13/00 24/615
5,390,571 A * 2/1995 Fox, III ..... B25B 23/0021 403/325
6,637,908 B1 10/2003 Hung
8,096,527 B2 1/2012 Naijiang et al.
2005/0135876 A1 6/2005 Lin

FOREIGN PATENT DOCUMENTS

JP 2005306595 A 11/2005

OTHER PUBLICATIONS

Database for Vintage and Classic Shelley Vehicle Jackson, pp. 1 to 34, dated Aug. 20, 2014, http://www.mgaroadster.co.uk/shelley_jacks.htm.

* cited by examiner

*Primary Examiner* — Thomas Diaz
(74) *Attorney, Agent, or Firm* — Gregory P. Brown; Law Firm of Dr. Junqi Hang, PLC

(57) ABSTRACT

The present invention in one or more embodiments provides a jack tool including a first shaft including a first tail with a first protrusion connected to a first spring, and a second shaft including a second head with a second aperture to detachably receive the first protrusion of the first shaft upon a force on the first spring translated from a force of different direction on the first protrusion.

20 Claims, 6 Drawing Sheets

EXTENDABLE JACK TOOL AND JACK ASSEMBLY EMPLOYING THE SAME

RELATED APPLICATION(S)

This application claims the benefit of Chinese New Invention Patent Application No.: CN201310683939.8, filed Dec. 13, 2013, the entire contents thereof being incorporated herein by reference.

TECHNICAL FIELD

The disclosed inventive concept relates generally to extendable jack tool and jack assembly employing the same.

BACKGROUND

Jack tools have been used to lift weights and particularly weights imparted by a parked vehicle. In certain existing technologies, jack tools may be made extendable, however, via cumbersome and complicated connections.

It would thus be advantageous if jack tools with relatively simple and easy to operate mechanism of connection may be produced without these identified problems.

SUMMARY

The present invention in one or more embodiments provides a jack tool including a first shaft including a first tail with a first protrusion connected to a first spring, and a second shaft including a second head with a second aperture to detachably receive the first protrusion of the first shaft upon a force on the first spring translated from a force of different direction on the first protrusion.

The first shaft may further include a first head and a first body, the first body being positioned between the first head and the first tail, the first head being of a cross-section different from that of the first tail. The first head, the first body and the first tail may be integral in material to one another. The second shaft may further include a second tail and a second body, the second body being positioned between the second head and the second tail, the second head being of a cross-section different from that of the second tail. The second head, the second body and the second tail may be integral to one another.

The first tail may further include a first tail body positioned between and connecting the first protrusion and the first spring. The first tail body may include a first tail body portion having a first slanted surface and a second tail body portion having a second slanted surface, wherein the first slanted surface is positioned to push the second slanted surface upon the force imparted on the first protrusion. The second tail body portion may be positioned between the first spring and the first tail body portion.

The first tail body portion may include a first tail body top wall and a first tail body bottom wall, the first tail body top wall being positioned between the protrusion and the first tail body bottom wall, the first tail body top wall having a longer longitudinal length than the first tail body bottom wall.

The present invention in another or more embodiments provides a jack tool including a first shaft including a first head with a first aperture and a first tail with a first protrusion connected to a first spring, a second shaft including a second tail and a second head with a second aperture to detachably receive the first tail, and a third shaft including a third head and a third tail with a third protrusion connected to a third spring, the third protrusion being detachably connectable to the first head via the third spring.

The above advantages and other advantages and features will be readily apparent from the following detailed description of embodiments when taken in connection with the accompanying drawings.

BRIEF DESCRIPTION OF THE DRAWINGS

For a more complete understanding of embodiments of this invention, reference should now be made to the embodiments illustrated in greater detail in the accompanying drawings and described below by way of examples wherein.

DETAILED DESCRIPTION OF ONE OR MORE EMBODIMENTS

Figure 1:
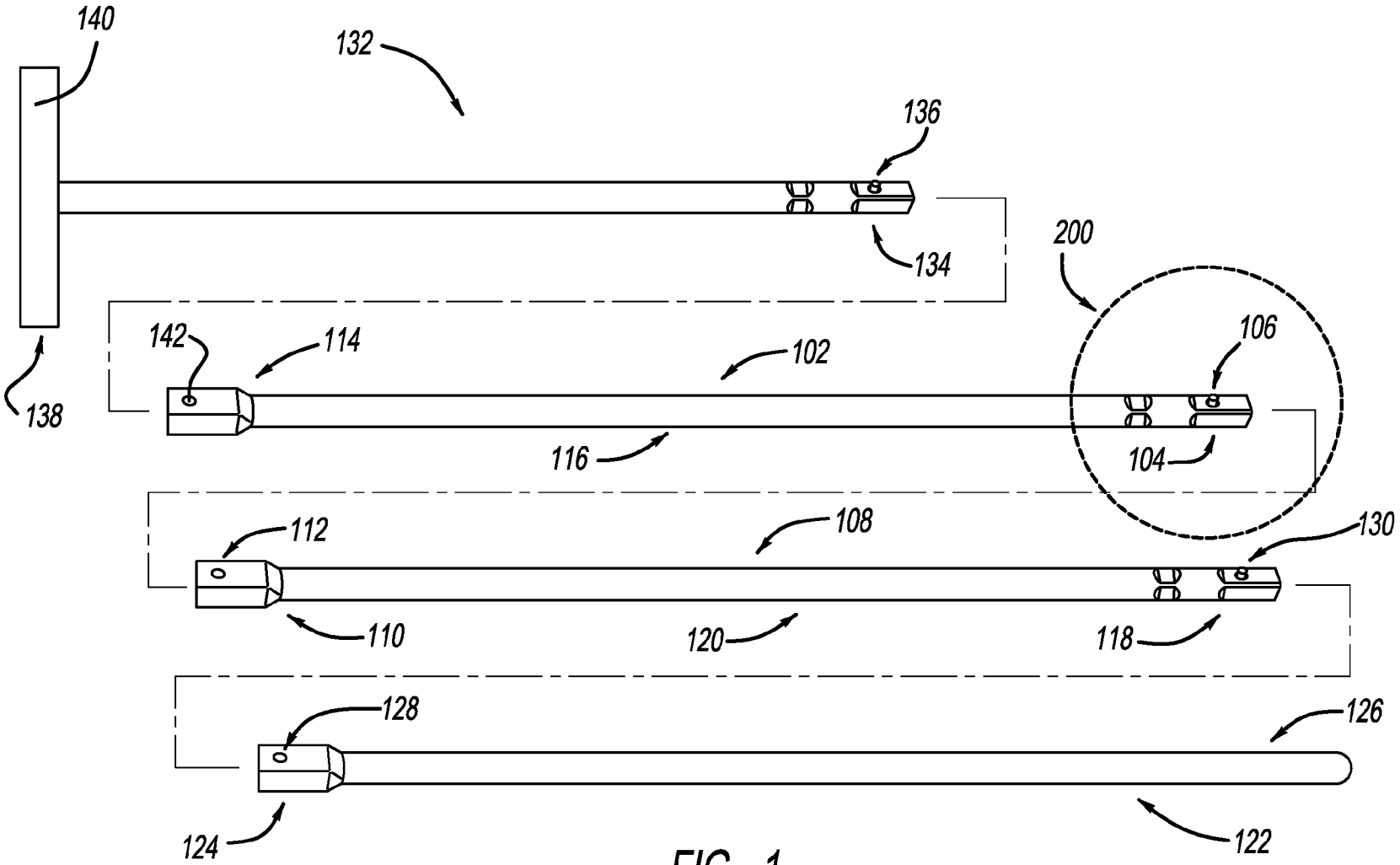
FIG. 1 illustratively depicts a perspective view of a jack tool in one or more embodiments.

As referenced in the FIGS., the same reference numerals are used to refer to the same components. In the following description, various operating parameters and components are described for different constructed embodiments. These specific parameters and components are included as examples and are not meant to be limiting.

The disclosed inventive concept is believed to overcome one or more of the problems associated with known production and/or use of a jack tool.

In one or more embodiments, and as illustratively depicted in FIG. 1, a jack tool generally shown at 100 includes a first shaft 102 including a first tail 104 with a first protrusion 106, and a second shaft 108 including a second head 110 with a second aperture 112 to detachably receive the first protrusion 106 of the first shaft 102 upon a force on the first protrusion 106.

The first shaft 102 may include a first head 114 and a first body 116, the first body 116 being positioned between the first head 114 and the first tail 104, the first head 114 being of a cross-section different from a cross-section of the first tail 104. For instance, the first head 114 may have an outer perimeter in the shape of a rectangular or a square while the first tail 104 may have an outer perimeter in the shape of a circle.

The first head 114, the first body 116 and the first tail 104 may be integral in material to one another. In other words, the first head 114, the first body 116 and the first tail 104 may be formed via a one-shot molding process using one and same material.

The second shaft 108 may include a second tail 118 and a second body 120, the second body 120 being positioned between the second head 110 and the second tail 118, the second head 110 being of a cross-section different from a cross-section of the second tail 118. For instance, the second head 110 may have an outer perimeter in the shape of a rectangular or a square while the second tail 118 may have an outer perimeter in the shape of a circle.

The second head 110, the second body 120 and the second tail 118 may be integral in material to one another. In other words, the second head 110, the second body 120 and the second tail 118 may be formed via a one-shot molding process using one and same material.

In another or more embodiments, and as illustratively depicted in FIG. 1, the jack tool 100 may further include a third shaft 122 including a third head 124 and a third tail 126. The third head 124 is provided with a third aperture 128 to detachably receive the second protrusion 130 or the first protrusion 106.

When connected to the second protrusion 130 of the second shaft 108 which is in turn connected with the first shaft 102, the jack tool 100 in this configuration includes the first, second and third shafts, 102, 108 and 122. Based upon particular needs, one or more additional shafts may be positioned between the first and third shafts 102, 122 to increase the total length of the resulting jack tool 100.

In yet another or more embodiments, and as illustratively depicted in FIG. 1, the jack tool 100 may further include a fourth shaft 132 including a fourth tail 134 with a fourth protrusion 136. The fourth protrusion 136 may be received within the first head 114 via a first aperture 142 or within the second head 110 via the second aperture 112, through the same or similar spring mechanism for connection between the shafts described herein elsewhere. Based upon particular needs, one or more additional shafts may be positioned between the fourth shaft 132 and the first shaft 102, between the fourth shaft 132 and the second shaft 108, and between the fourth shaft 132 and the third shaft 122, such that the jack tool 100 may be obtained with variable total length.

Figure 3:
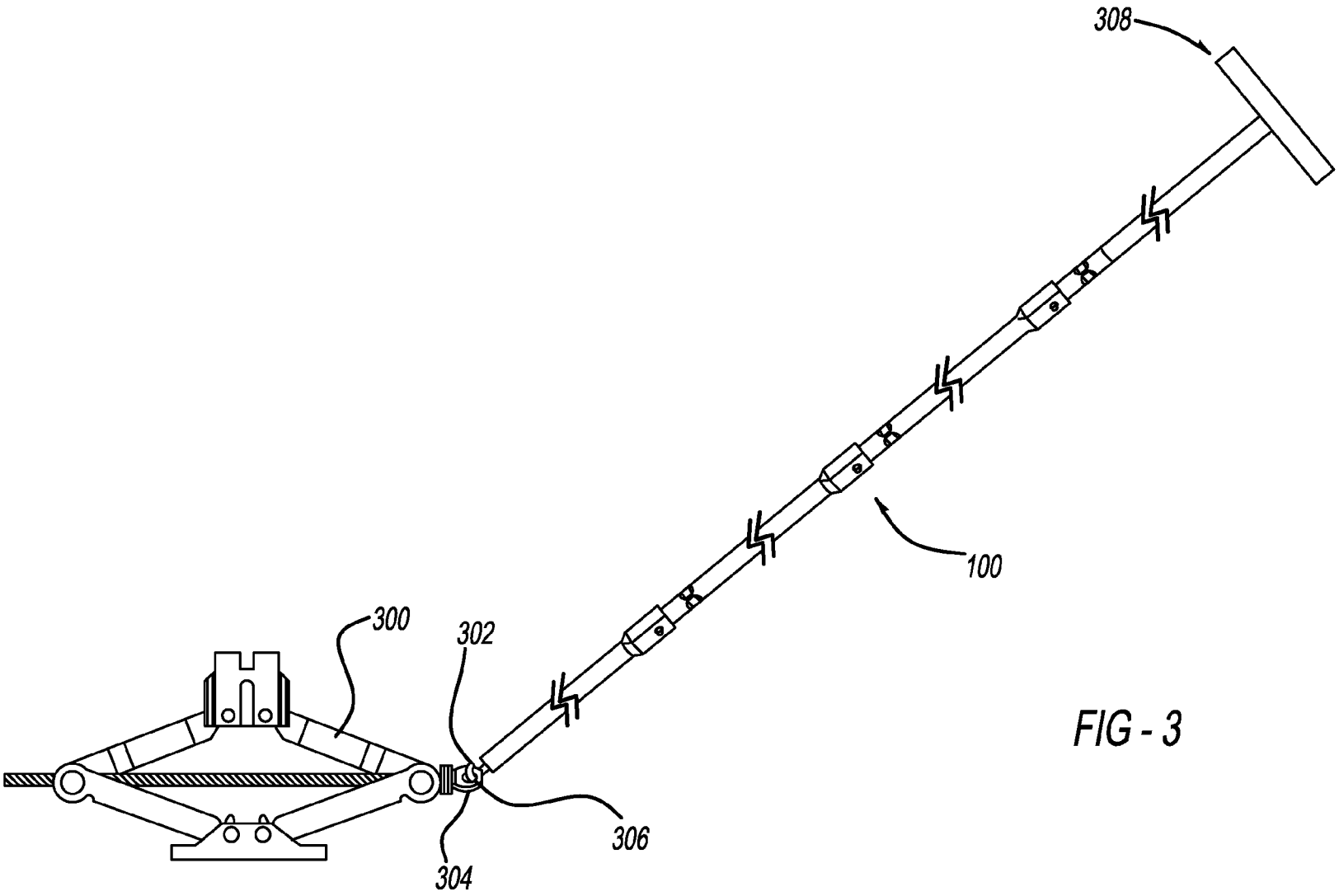
FIG. 3 illustratively depicts a jack assembly employing the jack tool referenced in FIG. 1.

Referring back to FIG. 1, the third tail 126 of the third shaft 122 may be configured to include a hook, such as end 302 depicted in FIG. 3, for connection to a jack.

Referring back to FIG. 1, the fourth shaft 132 may be provided with a fourth head 138 which is turn configured to include a handle 140 for use by an operator in operating the jack.

Although four individual shafts 102, 108, 122 and 132 are detailed herein in explaining the structure and the operation mechanism of the jack tool 100, the total number of individual shafts may vary based on particular needs at hand.

The first head 114, the second head 110, and the third head 124 may each have a cross-section same to or different from one another in size and/or in shape. This is permissible as long as the first, second and third heads 114, 110 and 124 are each sized to properly receive the fourth tail 134, the first tail 104, and the second tail 118, respectively.

Any components of the jack tool 100 described herein may be made of any suitable material, which is preferably durable for multiple use and cheap for material construction. A non-limiting example of the material includes steel.

Any individual shaft of the jack tool 100, such as the first shaft 102, second shaft 108, the third shaft 122 and the fourth shaft 132, may be of the same or different length relative to each other. For the ease of storage and transport, the shafts may be of the same length to each other.

Figure 2A:
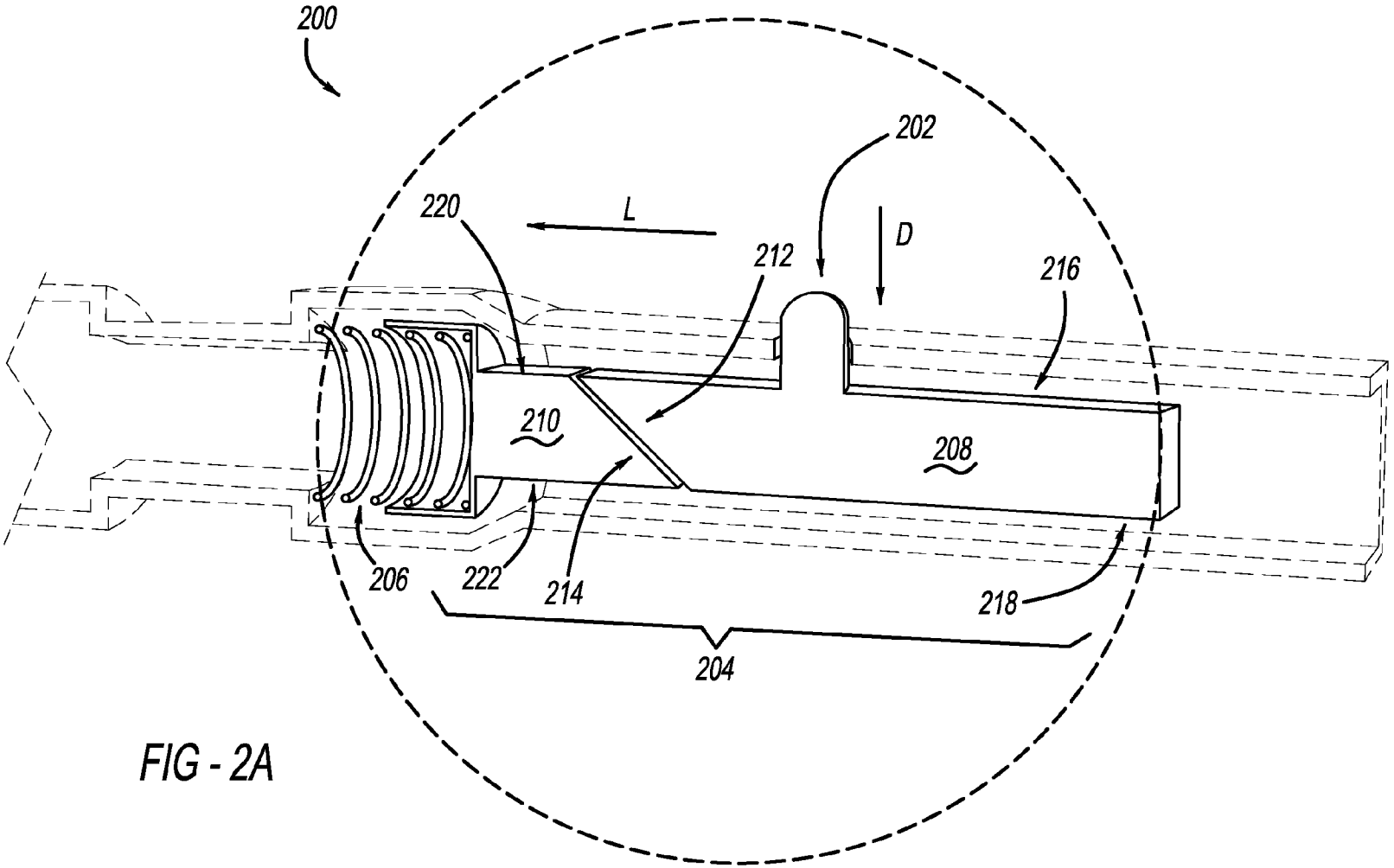
FIG. 2A illustratively depicts an enlarge, partial cross-sectional view of the jack tool referenced in FIG. 1.

FIG. 2A illustratively depicts an enlarged partial cross-sectional view of the first tail 104, the second tail 118, or the fourth tail 134 referenced in FIG. 1, collectively termed a tail 200. In FIG. 2A, a protrusion 202 collectively represents any one of the protrusions 106, 130 and 136 referenced in FIG. 1. The protrusion 202 extends to a tail body 204 which is in turn connected to a spring 206. In operation, and via a downward force being imparted onto the protrusion 202, the spring 206 is compressed and the tail 200 may then be released from the engagement from or the connection to the first, second or third head 114, 110 or 124.

In certain instances, and to further the ease of disengagement, the tail body 204 may be formed of a first tail body portion 208 having a first slanted surface 212 and a second tail body portion 210 with a second slanted surface 214, wherein the first slanted surface 212 pushes the second slanted surface 214 in a direction "L" that is different from the downward direction "D" in which the protrusion 202 may move. In essence, the first and second tail body portions 208, 210 work together to convert the direction of an imparted force from the downward direction "D" to a longitudinal direction "L" such that the externally imparted force is translated, indirectly, onto the spring 206.

Referring back to FIG. 2A, the first slanted surface 212 is positioned between and defined by a first tail body top wall 216 and a first tail body bottom wall 218. The first tail body top wall 216 is positioned closer to the protrusion 202 and has a longer liner dimension relative to the first tail body bottom wall 218.

Referring back to FIG. 2A, the second slanted surface 214 is positioned between and defined by a second tail body top wall 220 and a second tail body bottom wall 222. The second tail body top wall 220 is positioned closer to the protrusion 202 and has a shorter liner dimension relative to the second tail body bottom wall 222.

Referring back to FIG. 2A, the protrusion 202 may be formed integral in material to the tail 200, and in particular integral in material to the first tail body portion 208. In certain instances, the protrusion 202 may be formed integral in material to an outer surface of the tail 200 or the first tail body portion 208 of the tail 200 if the tail 200 and/or the protrusion 202 is configured with a hollow interior. To make integral in material, the protrusion 202 and the tail 200 or the first tail body portion 208 via a one-shot molding process.

The spring may be a coil spring or a helical spring. Without wanting to be limited to any particular theory, it is believed that the coil spring is a mechanical device to store energy due to resilience and subsequently release it, to absorb shock, or to maintain a force between contacting surfaces. The coil spring may be made of an elastic material formed into the shape of a helix which may return to its natural length when unloaded. Any suitable types of the coil spring may be used. A non-limiting example of the coil spring includes a torsion spring, the material thereof acting in torsion when the spring is compressed or extended. Metal coil springs may be made by winding a wire around a shaped former such as a cylinder to form cylindrical coil springs.

Figure 2B:
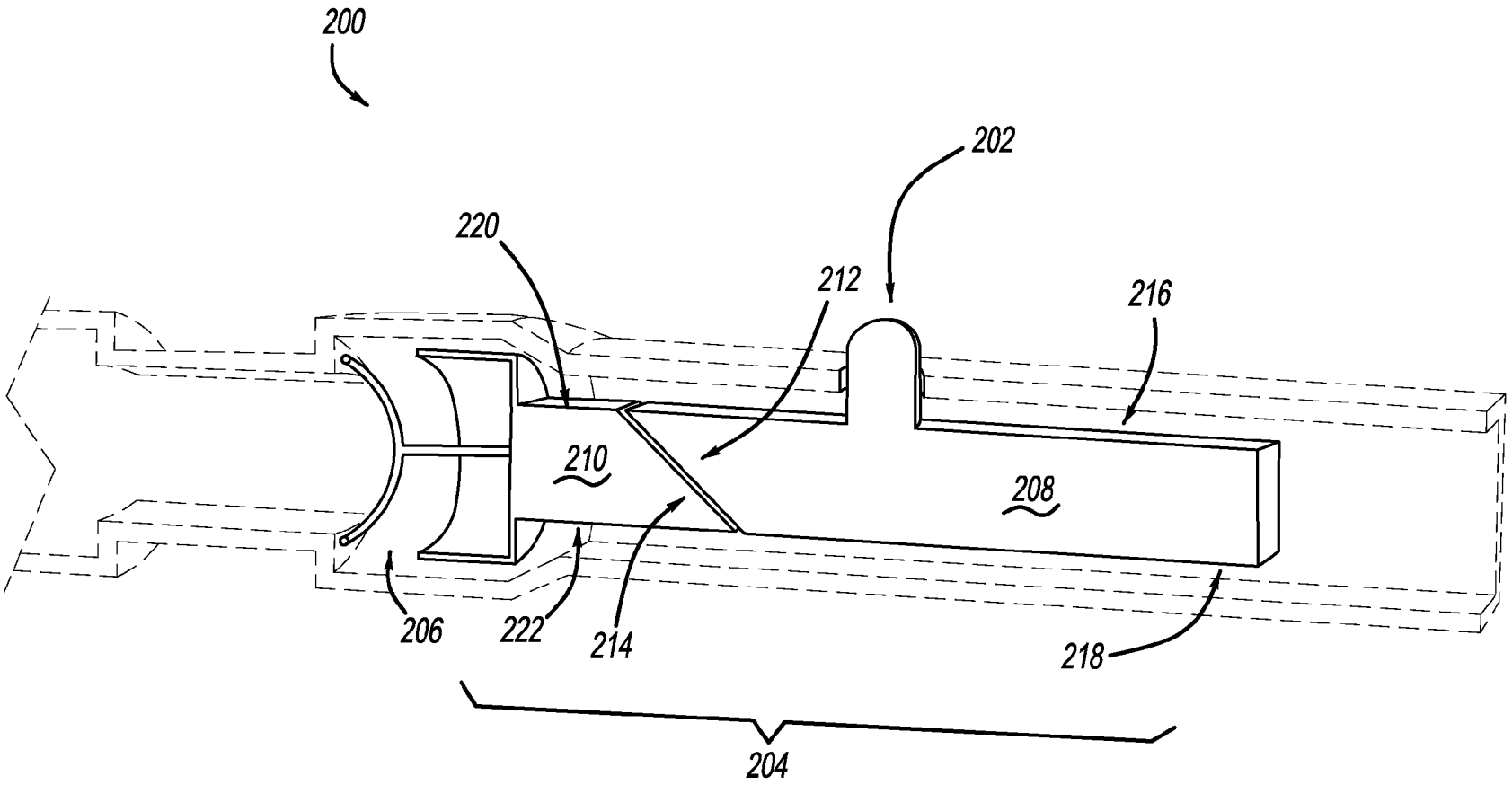
FIG. 2B illustratively depicts an alternative view of the jack tool referenced in FIG. 2A.
Figure 2C:
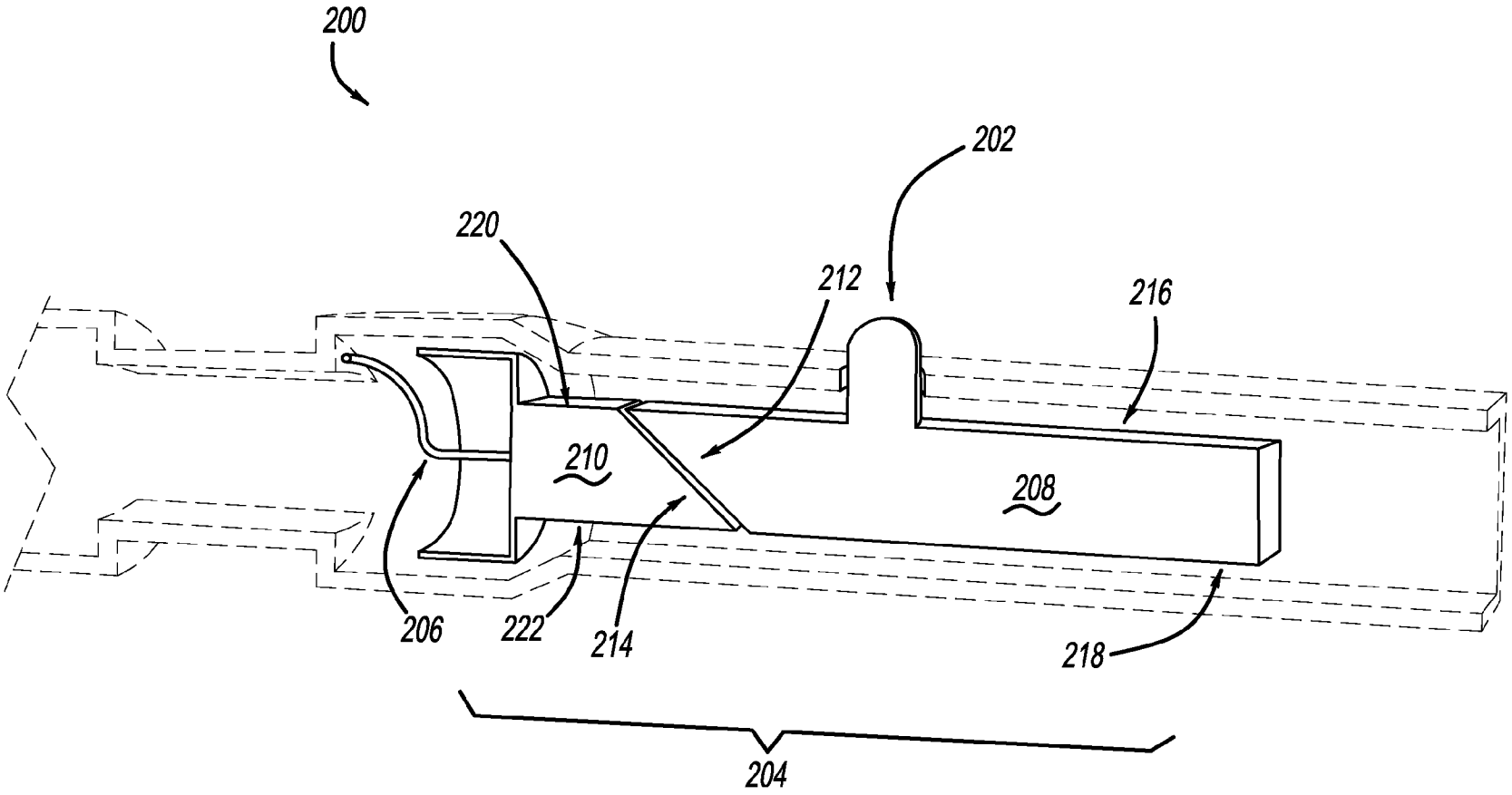
FIG. 2C illustratively depicts an alternative view of the jack tool referenced in FIG. 2A.
Figure 2D:
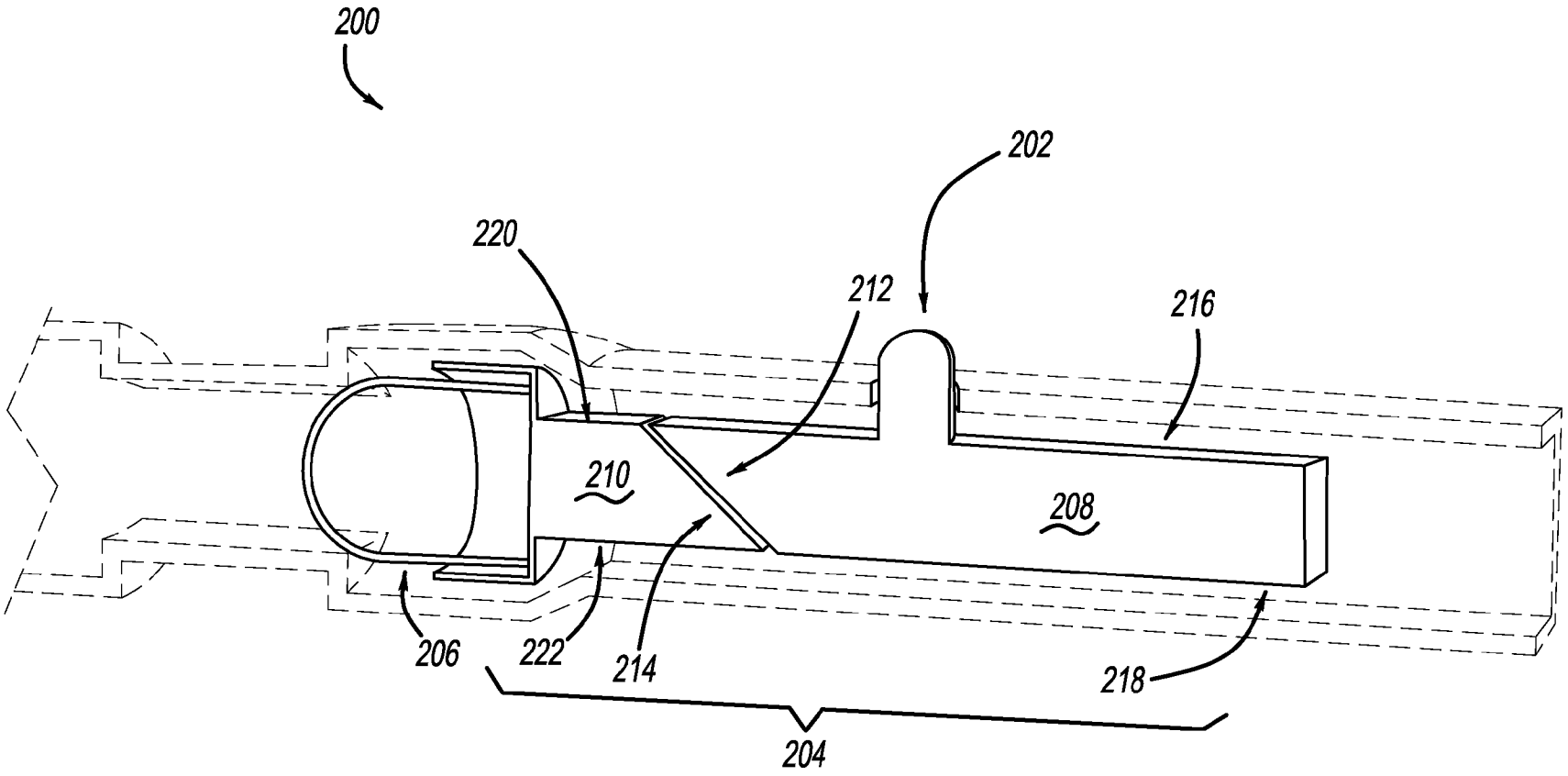
FIG. 2D illustratively depicts an alternative view of the jack tool referenced in FIG. 2A.

The spring 206 can take various shape and form as long as the spring 206 is configured suitable for the intended purpose as described herein elsewhere. For instance, the spring 206 may be configured as including two resilient legs as illustratively depicted in FIG. 2B, as including one resilient leg as illustratively depicted in FIG. 2C, or as including a U-shaped resilient sheet as illustratively depicted in FIG. 2D.

FIG. 3 illustratively depicts a jack 300 being operated on via the jack tool 100 referenced in FIG. 1. To operate the jack 300, the jack tool 100 is connected to a screw head 304 of the jack 300. In certain instances, and as depicted in FIG. 3, the screw head 304 may be provided with an aperture 306 through which the end 302 of the jack tool 100 is connected to the jack 300. In certain particular instances, the end 302 may be configured as a hook.

Once connected, a handle bar 308 of the jack tool 100 may be turned either clockwise or counterclockwise to drive the jack tool 100; and according with the connection effected at the end 302, the jack 300 is lifted or restored to its original position.

Because the jack tool 100 may be provided with variable length as needed, and because of the relative ease with which the extension may be realized, an operator may adopt a standing pose instead of a squatting pose when operating the jack 300. This benefits the convenience of the operation and reduces the working intensity of the operator. When the operation is finished, the jack tool 100 may be shortened via the simple pressing on the protrusion to cause disengagement and separation of the sections.

In one or more embodiments, the disclosed invention as set forth herein overcomes the challenges faced by known production ofa jack tool for use with a jack. However, one skilled in the art will readily recognize from such discussion, and from the accompanying drawings and claims that various changes, modifications and variations can be made therein without departing from the true spirit and fair scope of the invention as defined by the following claims.

What is claimed is:

1. A jack tool comprising:

a first shaft including a first tail-body-portion connecting a first protrusion and a second tail-body-portion connecting a first spring; and a second shaft including an aperture from which the first protrusion is releasable when a first slanted-surface of the first tail-body-portion pushes a second slanted-surface of the second tail-body-portion to impart a force on the first spring translated from a force of different direction on the first protrusion.

2. The jack tool of claim 1, wherein the first shaft further includes a first head and a first body, the first body being positioned between the first head and the first tail-body-portion, the first head being of a cross-section different from that of the first tail-body-portion.

3. The jack tool of claim 1, wherein the first protrusion is integral in material to an outer surface of the first tail-body-portion.

4. The jack tool of claim 1, wherein the second shaft includes a second head, a second tail and a second body, the aperture being positioned on the second head, the second body being positioned between the second head and the second tail, and the second head being of a cross-section different from that of the second tail.

5. The jack tool of claim 4, wherein the second head, the second body and the second tail are integral in material to one another.

6. The jack tool of claim 1, wherein the second tail-body-portion is positioned between the first spring and the first tail-body-portion.

7. The jack tool of claim 6, wherein the first tail-body-portion includes a first tail-body-top-wall and a first tail-body-bottom-wall, the first tail-body-top-wall being positioned between the first protrusion and the first tail-body-bottom-wall, the first tail-body-top-wall having a longer longitudinal length than the first tail-body-bottom-wall.

8. The jack tool of claim 1, wherein the first tail-body-portion extends beyond the first protrusion along a longitudinal direction of the first shaft to be further away from the first spring.

9. A jack tool comprising:

a shaft including a head with an aperture and a tail with a protrusion connected to a spring, wherein the tail further includes a tail body positioned between and connecting the protrusion and the spring, wherein the tail body includes a first tail-body-portion having a first slanted-surface and a second tail-body-portion having a second slanted-surface, and wherein the first slanted-surface is positioned to push the second slanted-surface to impart a force on the spring translated from a force of different direction on the protrusion, such that the shaft is releasable from a second shaft when the protrusion is released from a second aperture of the second shaft upon the force of different direction imparted on the protrusion.

10. The jack tool of claim 9, wherein the second tail-body-portion is positioned between the spring and the first tail-body-portion.

11. The jack tool of claim 9, wherein the first tail-body-portion includes a first tail-body-top-wall and a first tail-body-bottom-wall, the first tail-body-top-wall being positioned between the protrusion and the first tail-body-bottom-wall, the first tail-body-top-wall having a longer longitudinal length than the first tail-body-bottom-wall.

12. The jack tool of claim 9, wherein the head, the body and the tail are integral in material to one another.

13. The jack tool of claim 9, wherein the head is of a cross-section different from that of the tail.

14. The jack tool of claim 9, wherein the head is of a material different from the tail.

15. The jack tool of claim 9, wherein at least one of the head and the tail is of a material different from the body.

16. The jack tool of claim 9, wherein the first tail-body-portion extends beyond the protrusion along a longitudinal direction of the shaft to be further away from the spring.

17. A jack assembly comprising:

a jack tool including first, second and third shafts, the first shaft including a first head with a first aperture and a first tail with a first protrusion connected to a first spring, the second shaft including a second tail with a second protrusion connected to a second spring and a second head with a second aperture to detachably receive the first tail, and the third shaft including a third head with a third aperture to detachably receive the second tail, wherein at least one of the first and second tails includes first and second tail-body-portions, and wherein a first slanted-surface of the first tail-body-portion is to push a second slanted-surface of the second tail-body-portion upon a force respectively imparted onto the at least one of the first and second springs while the force is translated from a force of different direction on the at least one of the first and second protrusions; and a jack detachably connectable to the jack tool.

18. The jack assembly of claim 17, wherein the third tail or the first head includes a hook for connection to the jack.

19. The jack assembly of claim 17, wherein the third tail or the first head includes a handle for use by an operator.

20. The jack tool of claim 17, wherein the first tail-body-portion extends beyond the first protrusion along a longitudinal direction of the first shaft to be further away from the first spring.

* * * * *